United States Patent [19]

Barth et al.

[11] 4,153,150

[45] May 8, 1979

[54] COIN OPERATED LOCK

[75] Inventors: Douglas A. Barth, Sinclairville; Richard J. Chester, Kennedy, both of N.Y.

[73] Assignee: American Locker Security Systems, Inc., Jamestown, N.Y.

[21] Appl. No.: 851,397

[22] Filed: Nov. 14, 1977

[51] Int. Cl.[2] ..... G07F 1/04

[52] U.S. Cl. ..... 194/92

[58] Field of Search ..... 194/92, 65, 1 G, 78

[56] References Cited

U.S. PATENT DOCUMENTS 3,249,197 5/1966 Smith et al. ..... 194/65

3,938,640 2/1976 Stackhouse et al. ..... 194/92

*Primary Examiner*—Stanley H. Tollberg

*Attorney, Agent, or Firm*—Bean, Kauffman & Bean

[57] ABSTRACT

A two coin operated lock unit for effecting locking of a cabinet door, the improvement featuring the utilization of an improved coin selector mechanism adapted for adjustment to accommodate coins of differing denominations and for permitting free discharge of coins from the lock unit when of a diameter smaller than the diameter of a coin of a given denomination for which the selector mechanism is set, regardless of whether such coins are deposited before or after a first deposited coin of such given denomination.

8 Claims, 5 Drawing Figures

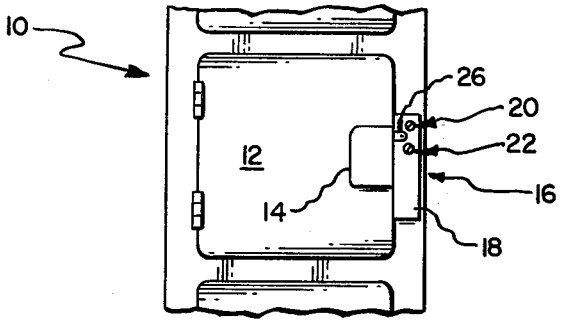
Fig. 1.
Fig. 2.
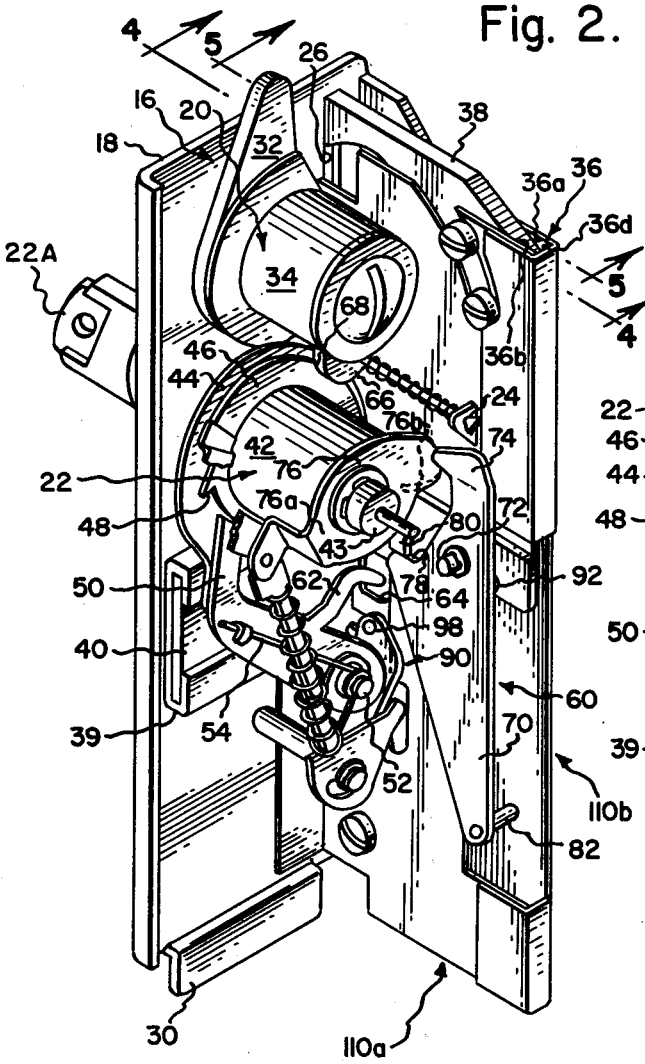
Fig. 3.
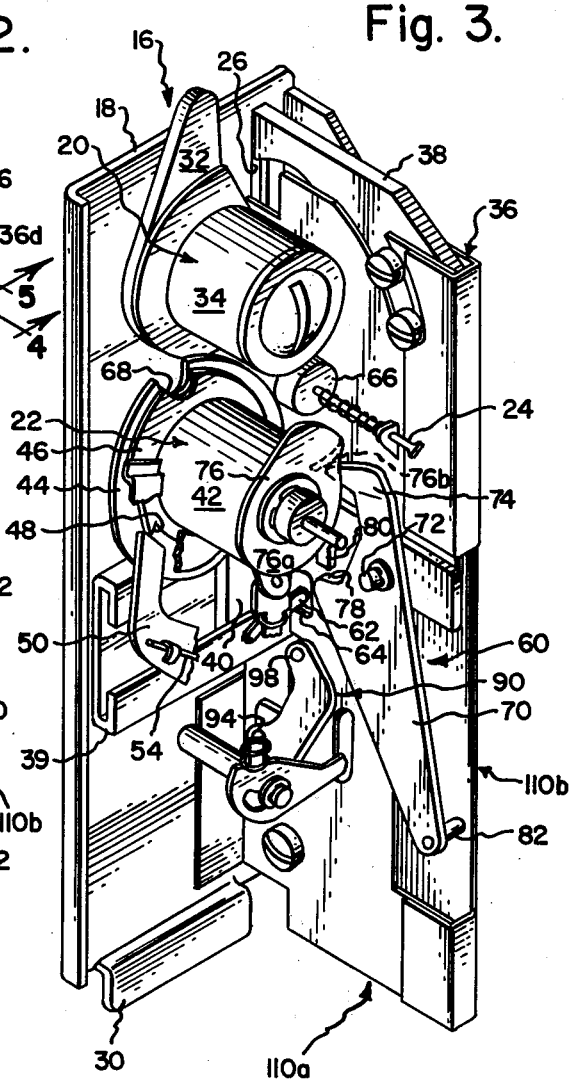

COIN OPERATED LOCK

BACKGROUND OF THE INVENTION

In U.S. Pat. No. 3,938,640, there is disclosed a selector mechanism adjustable to accommodate a lock unit for operation by a group of coins defined by a desired number of coins of a given denomination. This lock unit has the advantage of permitting accurate gauging of deposited coins with a minimum of structural parts subjected to wear and/or failure. However, a drawback of this prior construction is that the lock unit may be rendered inoperative, when an improper or mixed denomination group of coins are inserted into the lock unit; this requiring the attention of a custodian to remove the lock unit from its locker cabinet. Another drawback of this prior construction is that it cannot be readily mounted as a replacement for previously installed lock units of the type disclosed for instance in U.S. Pat. Nos. 3,228,506 or 3,599,770, when it is desired to increase the charge for use of such lockers.

In U.S. Pat. No. 3,613,855, there is disclosed a two-coin operated lock having the capability of discharging coins of a diameter smaller than the diameter of a given coin denomination regardless of whether such coins were deposited before or after the first coin of such given denomination. Thus, for a two-coin grouping, the construction of the lock unit disclosed by this patent avoids the above mentioned drawback of the lock unit construction discosed in U.S. Pat. No. 3,938,640. However, selector mechanism of U.S. Pat. No. 3,613,855 is difficult to adust to handle coins of a denomination differing from that for which the lock unit was originally designed; there is a possibility of jamming the coin chute and/or selector mechanism of the lock unit, if coins are deposited after the two proper or given denomination coins; and the selector mechanism of this patent is not readily adapted for use with the basic lock unit construction disclosed for instance in U.S. Pat. Nos. 3,228,506 and 3,599,770, such basic lock unit construction possessing certain advantages when compared to that of U.S Pat. No. 3,613,855.

SUMMARY OF THE INVENTION

The present invention is directed towards an improved two-coin selector mechanism, which may be readily adjusted to accommodate a lock unit for operation by coins of different denominations and is not subject to jamming due to insertion of groups of coins of mixed denominations.

The lock unit of the present invention employs an improved coin selector mechanism, which is characterized by simple rugged construction, but which is nonetheless extremely accurate and serves to prevent the lock unit from being rendered inoperative by patron insertion of mixed coin groups.

More specifically, the present selector mechanism employs a stationary gauging member and a movable gauging means in combination with a conventional coin intercepting finger movable between coin gauging and release positions incident to operation of the lock unit. The movable gauging means includes a pivotally supported arm, which carries lower and upper gauging pins adjacent its opposite ends for operative association with the intercepting finger and stationary gauging member, respectively, for the purpose of supporting first and second deposited coins of a given denomination of a given currency, while permitting discharge from the coin chute of coins of such currency, which are of a diameter smaller than that of the given denomination coin. The arm is balanced to permit relatively free movement thereof between its gauging and release positions, while being adapted to be positively moved/maintained in its gauging position whenever a first coin of a given denomination engages with the lower gauging pin. Thus, such first deposited coin serves to insure that the upper gauging pin is properly positioned to intercept a second deposited given denomination coin and maintain same in alignment with an appropriate coin feeler device. When the intercepting finger is subsequently moved into its release position to effect discharge of the first deposited coin, the arm is freed to move into its release position with the result that the second deposited coin is also discharged from the coin chute.

The mechanism of the present invention is particularly described for use with a basic lock unit construction of the type disclosed in U.S. Pat. Nos. 3,228,506 and 3,599,770, but is not limited thereto.

DRAWINGS

The present invention will now be described in detail in the following description taken with the accompanying drawings wherein:

FIG. 1 is a fragmentary front elevational view of a bank of checking lockers or cabinets adapted to receive a lock unit formed in accordance with the present invention; the construction of the checking lockers being conventional and forming no part of the present invention.

FIG. 2 is a perspective view of the lock unit employed in the present invention in its cabinet door unlocked condition;

FIG. 3 is a perspective view similar to FIG. 2, but showing the lock unit in cabinet door locked condition;

DETAILED DESCRIPTION

Figure 4:
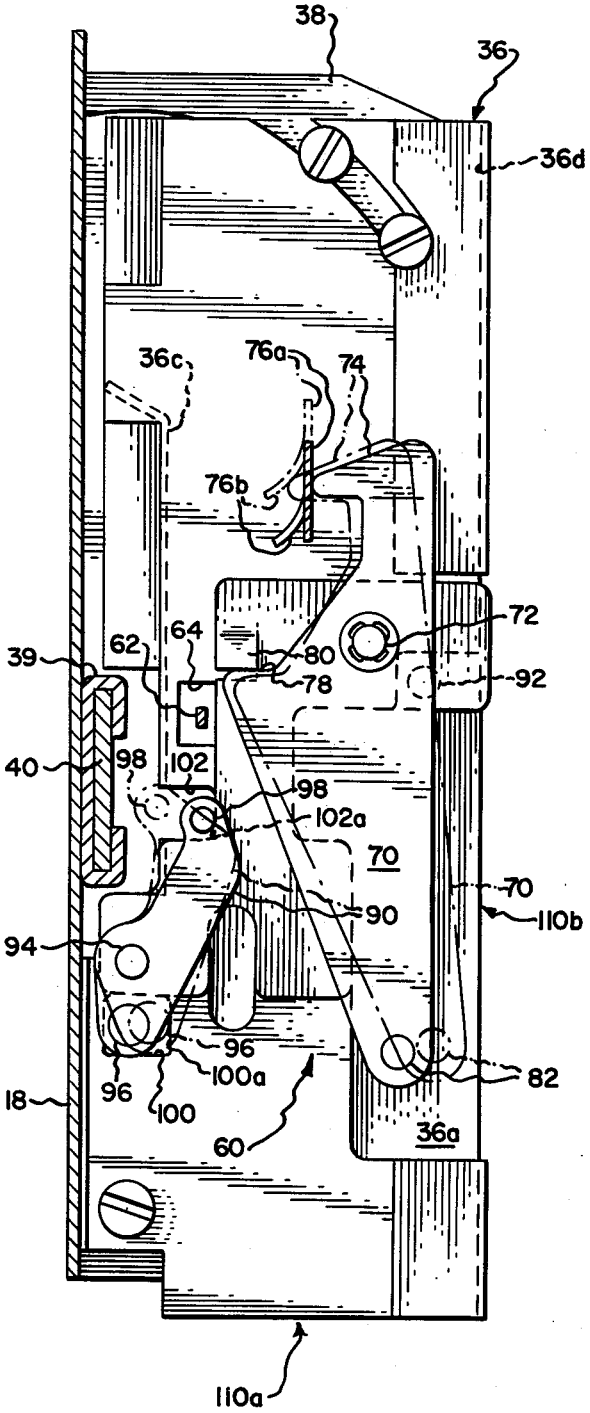
FIG. 4 is a sectional view taken generally along the line 4—4 in FIG. 2.

Now referring particularly to FIG. 1, 10 designates a bank of coin-control checking cabinets or lockers and 12 indicates a door closure of one of the cabinets on which is fixed a hand gripping block or flange 14 adapted to facilitate opening and closing of the door.

A locking unit 16, which is employed to lock door 12 in closed position is shown as including a face or front plate 18 through which extends a custodian or control lock 20, a patron lock 22 and a patron lock release rod 24. Face plate 18 is also shown as being apertured to define a coin insertion slot 26 and, if desired, may be formed with additional apertures to permit viewing of a suitable counter mechanism, not shown, and to provide for a coin return slot, also not shown.

The various elements forming lock unit 16 are normally mounted on face plate 18, so as to permit the lock unit to be removably secured within an opening, not shown, provided in a marginal portion of the cabinet adjacent door 12. To this end, lock unit 16 is preferably secured in place by cooperation of a face plate bottom lip 30 and a lip 32, which is carried by barrel 34 of a custodian lock 20. Barrel 34 may be rotated by means of a removable custodian control key, not shown, so as to move lip 32 counterclockwise from its position shown in FIG. 2 in order to enable the whole of the lock unit to be removed from the cabinet.

By again referring to FIG. 2, it will be understood that face plate 18 serves to mount a coin chute or guide 36 such as to position its inlet or upper end in communication with coin insertion slot 26 and its lower or discharge end in communication with a coin collection box, not shown, and/or if desired, a coin return mechanism, also not shown. Chute 36 may be considered as having coin side guiding surfaces 36*a* and 36*b*, which are aligned with the vertically extending side edges of insertion slot 26, and coin edge or front and rear guiding surfaces 36*c* and 36*d*, respectively. A coin slot blocking or constricting member 38 may be removably fixed in association with the inlet end of coin chute 36 in order to selectively control the maximum diameter of coins, which may be inserted through slot 26. Face plate 18 additionally serves to carry bracket 39, which serves to slideably support a locking bolt 40 for reciprocation between the contracted or cabinet door unlocking position shown in FIG. 2 and the extended or cabinet door position shown in FIG. 3.

By again referring to FIG. 2, it will be understood that patron lock 22 includes a cylindrical housing, not shown, which is non-removably carried by face plate 18; a cup-shaped barrel 42, which is rotatably supported on the cylindrical housing; and a lock cylinder, not shown, which is rotatably supported within the cylindrical housing, so as to permit rotation thereof under the control of a patron's key 22A. An end portion 43, which is connected to the rear of the patron lock cylinder, extends through the rear end of the cylindrical housing for driving connection with barrel 42, whereby to permit patron key induced rotations of the lock cylinder to be transmitted to the barrel. A disc 44 is fixed to the forward end of barrel 42 and provided with an arm, not shown, for connecting the barrel to lock bolt 40, such that the lock bolt is moved to an extended-locking position upon rotation of the barrel in a counter-clockwise direction, as viewed in FIGS. 2 and 3. A disc 46, which is also carried on the forward end of barrel 42, is notched to provide a shoulder 48 adapted to cooperate with a pawl 50, which is in turn pivotally supported by a pin shaft 52. A spring 54 serves to normally bias pawl 50 radially into contact with disc 46 for engagement with shoulder 48. When barrel 42 is in its normal unlocked position shown in FIG. 2, a non-illustrated, high-peripheral portion of disc 46 engages with pawl 50, so as to position the latter radially outwardly of shoulder 48. However, when barrel 42 is rotated in a counter-clockwise direction, as viewed in FIG. 2, spring 54 pivots pawl 50 inwardly, whereupon shoulder 48 engages the pawl and limits further rotation of the barrel in the absence of there being a pair of proper or given denomination coins supported and properly positioned within coin chute 36 by a coin intercepting or selector mechanism 60. When such coins are positioned within the coin chute, a coin feeler device in the form of a finger 62, which is formed integrally with pawl 50 and freely insertable through coin opening 64, engages with an aligned one of such coins and serves to hold pawl 50 in a position radially outwardly of shoulder 48, so as to permit shoulder 48 to move past the pawl as barrel 42 is rotated into its door locking position shown in FIG. 3.

A cylindrical stop device 66 mounted on release rod 24 is biased for receipt within side opening recesses 68 formed in discs 44 and 46 in order to normally constrain barrel 42 against rotation from its unlocked position. However, when door 12 is closed, rod 24 is depressed to remove stop device 66 from within recesses 68 and free the patron lock for rotation under the control of patron key 22A.

As thus far generally described, locking unit 16 is quite similar in structure and the mode of operation to the units described in the above mentioned U.S. Pats. Nos. 3,288,506 and 3,599,770. Moreover, mechanism 60 is similar to prior constructions from the standpoint that it includes a selector member in the form of a lever 70, which is pivotaly secured to coin chute 36 by a pivot pin 72 and has its upper end formed with a forwardly projecting finger or cam follower 74 arranged for operative sliding engagement with the rear surface 76 of barrel 42. Also, as in prior constructions, lever 70 is formed with an abutment edge surface 78 engageable with a stop 80 carried by coin chute 36 and carries a coin intercepting finger 82 adjacent its lower end. Surface 76 is characterized as having a flat or radially extending portion 76*a* and a forwardly inclined cam portion 76*b*. When the patron lock is arranged in its unlocked position shown in FIG. 2, finger 74 engages with surface portion 76*a* and edge surface 78 engages with stop 80 in order to constrain counter-clockwise and clockwise directed rotations, respectively, of lever 70 about the axis of pin 72, whereby to normally retain intercepting finger 82 in its coin gauging position shown in FIGS. 2, 3, and 4. When barrel 42 is rotated into locked position, cam portion 76*b* is placed in alignment with finger 74 in order to free lever 70 for movement into its release position shown in FIG. 3 and in broken line in FIG. 4, this serving to move intercepting finger 82 into its release position shown in full line in FIG. 3 and phantom line in FIGS. 4 and 5, wherein it is removed from supporting engagement with coins arranged within chute 36.

In the above mentioned prior constructions, intercepting finger 82 cooperates with a stationary coin gauging surface, such as may be defined by a lower end portion of front edge guide surface 36*c*, for the purpose of supporting a coin in gauging position, and the lock unit is characterized as having a single coin operating capacity.

In the present invention, intercepting finger 82 is employed in combination with a movable coin gauging means including a gauging arm 90 and a stationary coin gauging member or pin 92, in order to provide lock unit 16 with a two coin operating capacity, while at the same time preventing the lock unit from being rendered inoperative, due to insertion of improper groupings of coins.

More specifically, gauging arm 90 is shown in FIG. 4 as being mounted intermediate its ends on a pivot pin 94 and as carrying a lower or first and upper or second gauging pins or pawl 96 and 98, respectively, adjacent such ends. The pivot axis defined by pivot pin 94 is disposed essentially normal to the coin chute side guiding surfaces and gauging pins 96 and 98 are arranged to extend essentially parallel to such axis. By referring to FIGS. 4 and 5, it will be understood that lower gauging pin 96 is arranged to project inwardly of chute 36 through a chute side wall opening 100 for operative association with intercepting finger 86, and that upper gauging pin 98 is arranged to project inwardly of chute 36 through front side wall opening 102 for operative association with stationary gauging pin 92.

Figure 5:
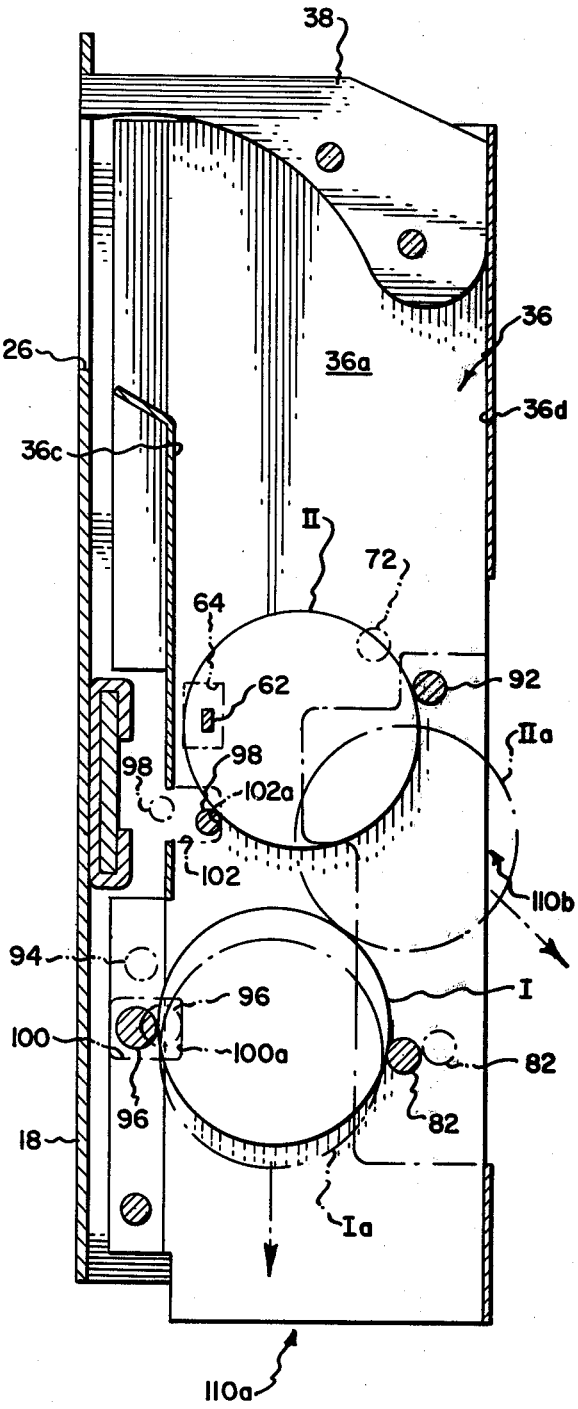
FIG. 5 is a sectional view taken generally along the line 5—5 in FIG. 2.

Pivot pin 94 serves to support arm 92 and thus gauging pins 96 and 98 for swinging movements between their gauging or first and release or second positions, which are shown in full and phantom line, respectively, in FIGS. 4 and 5. The gauging positions of arm 90 and gauging pins 96 and 98 may be suitably defined, as by engagement of upper gauging pin 98 with the inner edge 102*a* of front/side wall opening 102, whereas the release position of these elements may be suitably defined as by engagement of lower gauging pin 96 with the inner edge 100*a* of side wall opening 100. When lower and upper gauging pins 96 and 98 are disposed in their gauging positions, they are essentially uniformly spaced from intercepting finger 86, when in its gauging position, and stationary gauging member 92, respectively. through a distance sufficient to prevent passage downwardly therebetween of given denomination coins of a given currency intended to operate the lock unit, while permitting passage therebetween of improper coins of such given currency, i.e. coins having a diameter less than the given diameter of such given denomination coins. Of course, stationary gauging member 92 is spaced rearwardly of front edge guiding surface 36*c* through a distance sufficient to permit free passage therebetween of coins of such given denomination.

As by way of illustrating the capabilities of the present construction, mechanism 60 is shown as being adjusted to accommodate the lock unit for operation by a pair of French 1 Franc coins, which heretofore have posed operational or gauging difficulties for coin operated locks, due to the fact that French 20 Centimes coins are only slightly smaller in diameter than such 1 Franc coin. More specifically, in FIG. 5 first and second deposited 1 Franc coins are designated as I and II, respectively, whereas improper 20 Centimes coins deposited prior to coins I and II are designated as I*a* and II*a*, respectively.

In describing the operation of mechanism 60, it will be first assumed that the lock unit 16 is in its unlocked position, shown in FIG. 2, wherein intercepting finger 82 is disposed in its gauging position shown in FIGS. 4 and 5 and no coins have been deposited in coin chute 36. At this point in time the positioning of arm 90 and lower and upper gauging pins 96 and 98 is not critical, but preferably arm 90 would be balanced to assume its release position in order to remove upper gauging pin 98 from within the confines of coin chute 36 and thus prevent it from initially interfering with downward passage of coins through the chute. However, even if upper gauging pin 98 is initially disposed in its gauging position, the light weight structure of arm 60 and pins 96 and 98 permits the upper gauging pin to be swung from its gauging position when engaged by the first coin passing downwardly through the coin chute. If a patron, through either error or design, should first deposit an improper coin, e.g. coin I*a*, such coin will freely pass downwardly between stationary gauging pin 92 and upper gauging pin 98 or front edge guiding surface 36*c* and then downwardly between intercepting finger 82 and lower gauging pin 96 for discharge through a first or downwardly open discharge opening 110*a* of chute 36, as indicated in phantom line in FIG. 5. When the first given denomination coin is deposited, i.e. coin I, it will freely pass downwardly between stationary guide pin 92 and upper gauging pin 98 or front edge guiding surface 36*c*, and then come to rest in edge engagement with intercepting finger 82 and lower gauging pin 96. Upon engagement of coin I with lower gauging pin 96, the weight of such coin will cause arm 90 and pins 96 and 98 to swing in a first or clockwise direction, as viewed in FIG. 4, to assume their gauging positions if displaced therefrom. If a patron, through either error or design, should subsequently deposit another improper coin, i.e. coin II*a*, such coin would freely pass downwardly between stationary gauging pin 92 and upper gauging pin 98 and be discharged through a second discharge opening 110*b*, which opens horizontally through rear edge guiding surface 36*d* and extends at least essentially between stationary pin 92 and intercepting finger 82. When the patron finally deposits a second proper denomination coin, i.e. coin II, such coin will come to rest in edge engagement with upper gauging pin 98 and stationary gauging pin 92, and assume a gauging position in which it is disposed in alignment for sensing engagement by feeler finger 62.

As previously indicated, placement of coin II in alignment with coin feeler 62 permits operation of lock unit 16 by patron key 22A for the purpose of placing same in its locked condition illustrated in FIG. 3. This operation serves to release lever 70, with the result that intercepting finger 82 is free to move away from lower gauging pin 96 into its release position shown in phantom line in FIGS. 4 and 5. Movement of intercepting finger 82 into its release position may be effected by the weight of coin I or by the combined weight of such coin and proper balancing of lever 70. In any event, such movement frees coin I for discharge downwardly through first discharge opening 110*a*. It will be understood that incident to movement of the intercepting finger 82 into its release position, lower gauging pin 96 is freed from the constraint of coin I, thereby permitting upper gauging pin 98 to be swung away from its gauging position by the force of gravity acting on second deposited coin II. As upper gauging pin 98 moves relatively away from stationary gauging member 92 towards its release position, second deposited coin II is released and tends to pass outwardly through rear discharge opening 110*b* along with any coins which may have been deposited subsequent to coin II. Certain of such coins may, however, pass downwardly through lower discharge opening 110*a* without adversely effecting or jamming mechanism 60. Subsequently, when patron key 22*a* is employed to return the lock unit to its original unlocked condition in order to unlock cabinet door 12 and gain access to its associated locker cabinet, lever 70 is returned to its initial gauging position and the above described sequence of operation may be repeated.

It will be understood that mechanism 60 may be suitably adjusted in order to accommodate lock unit 16 for operation by given denomination coins of a currency other than French currency, such as by the expedient of varying the illustrated position of stationary gauging member 92 and the illustrated gauging position of intercepting finger 82, and/or the arm size/pin arrangement of the illustrated movable gauging means.

We claim:

1. In a coin operated lock of the type having a coin chute formed with vertically spaced coin inlet and discharge ends and serving to constrain coins for movement on edge downwardly therethrough, means for limiting passage of coins through said inlet to coins of a diameter equal to or less than a given diameter of a given denomination coin of a given currency intended to operate said lock, a coin selector mechanism having a coin intercepting finger arranged relatively adjacent said discharge end and operative when in a gauging position for supporting at least certain of the coins deposited in said chute, and a coin sensing means arranged relatively adjacent said inlet end for sensing the presence of a coin supported in said chute when in alignment therewith, characterized in that said lock may be moved from an unlocked into a locked condition only upon the sensing of the presence of a coin by said coin sensing means whereafter said coin intercepting finger is moved to a release position for releasing coins supported in said chute for discharge therefrom, the improvement comprising in combination:

said coin selector mechanism includes additional gauging means cooperating with said intercepting finger when in its gauging position for supporting a first deposited coin of said given denomination within said chute and supporting a second deposited coin of said given denomination within said chute above said first deposited coin and in alignment with said coin sensing means, while permitting discharge from said chute of improper coins of a diameter less than said given diameter when deposited before said second deposited coin, said intercepting finger upon movement thereof into its release position releasing said first deposited coin for discharge from said chute, and said additional gauging means being responsive to release of said first deposited coin for releasing said second deposited coin for discharge from said chute.

2. In a coin operated lock of the type having a coin chute formed with vertically spaced coin inlet and discharge ends and serving to constrain coins for movement on edge downwardly therethrough, means for limiting passage of coins through said inlet to coins of a diameter equal to or less than a given diameter of a given denomination coin of a given currency intended to operate said lock, a coin selector mechanism having a coin intercepting finger arranged relatively adjacent said discharge end and operative when in a gauging position for supporting at least certain of the coins deposited in said chute, and coin sensing means arranged relatively adjacent said inlet end for sensing the presence of a coin supported in said chute when in alignment therewith, characterized in that said lock may be moved from an unlocked into a locked condition only upon the sensing of the presence of a coin by said sensing means whereafter said coin intercepting finger is moved to a release position for releasing coins supported in said chute for discharge therefrom, the improvement comprising in combination:

said coin selector mechanism additionally includes a stationary gauging member arranged within said chute, said intercepting finger being disposed relatively below said stationary gauging member; and movable gauging means, said movable gauging means cooperating with said intercepting finger when in its gauging position and said stationary gauging member for supporting a first deposited coin of said given denomination within said chute in engagement with said intercepting finger and supporting a second deposited coin of said given denomination within said chute in engagement with said stationary gauging member for alignment with said coin sensing means while permitting discharge from said chute of improper coins of a diameter less than said given diameter deposited before said second deposited coin, said intercepting finger upon movement thereof into its release position releasing said first deposited coin for discharge from said chute, and said movable means being responsive to release of said first deposited coin for releasing said second deposited coin for discharge from said chute.

3. An improvement according to claim 2, wherein said movable gauging means includes lower and upper gauging members supported for conjunctive movements relative to said chute between first and second positions, said lower and upper gauging members when in said first positions thereof, cooperating with said intercepting finger and said stationary gauging member for supporting said first and second deposited coins, respectively, release of said first deposited coin freeing said lower and upper gauging members for movement into said second positions thereof, and movement of said upper gauging member into said second position releasing said second deposited coin for discharge from said chute.

4. An improvement according to claim 3, wherein said lower and upper gauging members are supported on opposite ends of an arm, and said arm is supported for pivotal movements relative to said coin chute.

5. In a coin operated lock of the type having a coin chute formed with vertically spaced coin inlet and discharge ends and being bounded at least in part by a pair of vertically extending coin edge guiding surfaces and a pair of vertically extending coin side guiding surfaces for constraining coins to move on edge downwardly therethrough, means for limiting passage of coins through said inlet end to coins of a diameter equal to or less than a given diameter of a given denomination coin of a given currency intended to operate said lock, a coin selector mechanism including a coin intercepting finger arranged relatively adjacent said discharge end and operable when in gauging position for releasably supporting at least certain of the coins deposited in said chute, and a coin feeler arranged relatively adjacent said inlet end and removably inserted into said chute adjacent one of said edge guiding surfaces for sensing the presence of a coin supported in said chute when in alignment therewith, characterized in that said lock may be moved from an unlocked into a locked condition only upon the sensing of the presence of a coin by said coin feeler whereupon said coin intercepting finger is moved to a release position for releasing coins supported in said chute for discharge therefrom, the improvement comprising in combination:

said coin selector mechanism additionally includes a stationary gauging member arranged within said chute adjacent the other of said coin edge guiding surfaces and relatively above said intercepting finger and a movable gauging means supported adjacent said one edge guiding surface and being operatively associated with said intercepting finger when in its gauging position and said stationary gauging member for supporting a first deposited coin of said given denomination within said coin chute in engagement with said intercepting finger and supporting a second deposited coin of said given denomination within said coin chute in engagement with said stationary gauging member at a gauging position above said first coin and in alignment with said coin feeler, while permitting discharge from said chute of improper coins of a diameter less than said given diameter deposited prior to said second deposited coin, said intercepting finger upon movement thereof into its release position releasing said first deposited coin for discharge from said chute and said movable gauging means being operative to release said second deposited coin for discharge from said chute incident to movement of said intercepting finger into its release position.

6. In a coin operated lock of the type having a coin chute formed with vertically spaced coin inlet and discharge ends and being bounded at least in part by a pair of vertically extending coin edge guiding surfaces and a pair of vertically extending coin side guiding surfaces for constraining coins to move on edge downwardly therethrough, means for limiting passage of coins through said inlet end to coins of a diameter equal to or less than a given diameter of a given denomination coin of a given currency intended to operate said lock, a coin selector mechanism including a coin intercepting finger arranged relatively adjacent said discharge end and operable when in gauging position for releasably supporting at least certain of the coins deposited in said chute, and a coin feeler arranged relatively adjacent said inlet end and removably inserted into said chute adjacent one of said edge guiding surfaces for sensing the presence of a coin supported in said chute when in alignment therewith, characterized in that said lock may be moved from an unlocked into a locked condition only upon the sensing of the presence of a coin by said coin feeler whereupon said coin intercepting finger is moved to a release position for releasing coins supported in said chute for discharge therefrom, the improvement comprising in combination:

said coin selector mechanism additionally includes a stationary gauging member arranged within said chute adjacent the other of said edge guiding surfaces and at a point above said intercepting finger; and movable gauging means, said movable gauging means including an arm mounting lower and upper gauging pins, said arm being supported for pivotal movements relative to said coin chute and to arrange said lower and upper gauging pins relatively adjacent said one coin edge guiding surface and relatively below said coin feeler, said arm having a first pivotal position wherein said lower gauging pin cooperates with said intercepting finger when in its gauging position to support a first deposited coin of said given denomination while permitting previously deposited coins of a diameter less than said given diameter to pass downwardly therebetween and wherein said upper gauging pin cooperates with said stationary gauging member to support a second deposited coin of said given denomination in a gauging position for alignment with said coin feeler while permitting previously deposited improper coins of a diameter less than said given diameter to pass downwardly therebetween, said intercepting finger when moved into said release position thereof releasing said first deposited coin for discharge from said chute, said lower gauging pin maintaining said arm in said first position incident to engagement thereof by said first deposited coin, and release of said first deposited coin freeing said arm for movement into a second position for removing said upper gauging member from supporting engagement with said second deposited coin whereby to release same for discharge from said chute.

7. An improvement according to claim 6, wherein said discharge end of said coin chute includes a first downwardly open discharge opening and a second horizontally open discharge opening extending generally vertically intermediate said intercepting finger and said stationary gauging member, characterized in that said first deposited coin and improper coins deposited previous thereto tend to be discharged through said first opening and said second deposited coin and improper coins deposited intermediate said first deposited coin and second deposited coin tend to be discharged through said second opening.

8. In a coin operated lock of the type having a coin chute formed with vertically spaced coin inlet and discharge ends and being bounded at least in part by a pair of vertically extending coin edge guiding surfaces and a pair of vertically extending coin side guiding surfaces for constraining coins to move on edge downwardly therethrough, means for limiting passage of coins through said inlet end to coins of a diameter equal to or less than a given diameter of a given denomination coin of a given currency intended to operate said lock, a coin selector mechanism including a coin intercepting finger arranged relatively adjacent said discharge end and operable when in a gauging position for releasably supporting at least certain of the coins deposited in said chute, and a coin feeler arranged relatively adjacent said inlet end and removably inserted into said chute adjacent one of said edge guiding surfaces for sensing the presence of a coin supported in said chute when in alignment therewith, characterized in that said lock may be moved from an unlocked into a locked condition only upon the sensing of the presence of a coin by said coin feeler whereupon said coin intercepting finger is moved from its gauging position into a release position for releasing coins supported in said chute for discharge therefrom, the improvement comprising in combination:

said coin selector mechanism additionally includes a stationary gauging member arranged within said chute adjacent the other of said edge guiding surfaces and at a point above said intercepting finger, and movable gauging means, said movable gauging means including an arm pivotally supported intermediate its ends for movements about an axis disposed essentially normal to said side guiding surfaces, lower and upper gauging pins fixed to said ends of said arm and extending essentially parallel to said axis, said lower and upper gauging pins being arranged for operative association with said intercepting finger and said stationary gauging member, respectively, said arm upon pivotal movement thereof in a first direction moving said lower and said upper gauging pins relatively away from and relatively toward said intercepting finger and said stationary gauging member, respectively, and means for limiting pivotal movement of said arm in said first direction to define a gauging position for said arm and said lower and upper gauging pins, wherein said lower and said upper gauging pins are essentially uniformly spaced from said intercepting finger when in its gauging position and said stationary gauging member, respectively, through a distance sufficient to prevent passage therebetween of coins of said given currency corresponding to said given denomination while permitting passage therebetween of improper coins of said given currency having a diameter less than said given diameter, said lower gauging pin when in its gauging position and said intercepting finger when in its gauging position cooperating to support a first deposited one of said given denomination coins, said upper gauging pin when in its gauging position cooperating with said stationary gauging member to support a second deposited one of said given denomination coins, said arm being balanced to reside in its gauging position when said first deposited coin is supported by said lower gauging pin and said intercepting finger and to swing in a direction opposite to said first direction incident to downward passage of said first deposited coin between said lower gauging pin and said intercepting finger upon movement of said intercepting finger into its released position, movement of said upper gauging pin from its gauging position incident to swinging movement of said arm in such opposite direction releasing said second deposited coin for passage downwardly between said upper gauging pin and said stationary gauging member; and said discharge end of said coin chute includes a first downwardly open discharge opening and a second horizontally open discharge opening extending generally vertically intermediate said intercepting finger and said stationary gauging member, characterized in that said first deposited coin and improper coins deposited previously thereto tend to be discharged through said first opening and said second deposited coin and improper coins deposited intermediate said first deposited coin and second deposited coin tend to be discharged through said second opening.

* * * * *